US006929564B2

(12) United States Patent
Olsavsky et al.

(10) Patent No.: US 6,929,564 B2
(45) Date of Patent: Aug. 16, 2005

(54) GOLF CLUB HEAD

(75) Inventors: Thomas Olsavsky, Encinitas, CA (US); Sean Toulon, Vista, CA (US); Mark A. Morgulis, San Diego, CA (US); Steven D. Gray, Poway, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 33 days.

(21) Appl. No.: 10/338,808

(22) Filed: Jan. 8, 2003

(65) Prior Publication Data

US 2004/0132542 A1 Jul. 8, 2004

(51) Int. Cl.[7] ..... A63B 53/04

(52) U.S. Cl. ..... 473/340; 473/349

(58) Field of Search ..... 473/340, 349, 473/324, 342, 341

(56) References Cited

U.S. PATENT DOCUMENTS

| | | | | |
|---|---|---|---|---|
| 2,222,534 A | | 12/1940 | Harris | |
| 3,368,812 A | | 2/1968 | Baldwin | |
| 3,516,674 A | | 6/1970 | Scarborough | |
| 3,758,115 A | | 9/1973 | Hoglund | |
| 3,873,094 A | * | 3/1975 | Sebo et al. | 473/250 |
| 3,979,123 A | | 9/1976 | Belmont | |
| D256,262 S | | 8/1980 | Benson | |
| 4,325,553 A | | 4/1982 | Taylor | |
| 4,422,638 A | | 12/1983 | Tucker | |
| D272,459 S | | 1/1984 | Jones | |
| D291,465 S | | 8/1987 | Antonious | |
| 4,995,612 A | | 2/1991 | Finney | |
| D320,638 S | | 10/1991 | Mermillod | |
| 5,058,895 A | | 10/1991 | Igarashi | |
| 5,080,365 A | | 1/1992 | Winchell | |
| 5,127,653 A | | 7/1992 | Nelson | |
| D333,331 S | | 2/1993 | Evans | |
| D342,558 S | | 12/1993 | Diesterheft | |
| 5,332,214 A | | 7/1994 | Tucker, Sr. | |
| 5,344,151 A | | 9/1994 | Anderson et al. | |
| D354,535 S | | 1/1995 | Queen | |
| 5,437,447 A | | 8/1995 | Rigutto | |
| D364,666 S | | 11/1995 | Nagy | |
| 5,489,097 A | | 2/1996 | Simmons | |

(Continued)

FOREIGN PATENT DOCUMENTS

| | | |
|---|---|---|
| FR | 2 752 742 | 8/1996 |
| JP | 09-028844 | 2/1997 |

OTHER PUBLICATIONS

Putters, http://www.marticogolf.com/putter–list.htm, 2003.
1991 Taylor Made Golf Catalog.
Dynacraft 1991 Clubmaking Catalog, p. 108.
Edwin Watts Summer 2002 Catalog, p. 41.
Edwin Watts Summer 2002 Catalog, p. 49.

*Primary Examiner*—Raleigh W. Chiu
(74) *Attorney, Agent, or Firm*—Sheppard, Mullin, Richter & Hampton L.L.P.

(57) ABSTRACT

A putter-type golf club head is provided having enhanced moment of inertia and alignment characteristics. The putter head includes a front body and a weight body. The weight body includes a central weight section extending rearwardly from the front body a prescribed distance to a rear weight section. The putter head is configured such that the rear weight section has a width less than the width of the front body and greater than a width of the central weight section. Thus, both the longitudinal and lateral moments of inertia are improved to offer greater forgiveness and increased accuracy during putts. The central weight section may include at least one and more preferably two elongated, high-density elements that are visible on a top surface of the sole between the front body and the rear weight section. The visibility of the elongated elements, with optional parallel markings on a top surface of the golf club head, also act as alignment aids to the golfer.

27 Claims, 3 Drawing Sheets

U.S. PATENT DOCUMENTS 5,580,058 A 12/1996 Coughlin
5,630,765 A 5/1997 Moore
5,685,784 A 11/1997 Butler
5,690,562 A * 11/1997 Sturm ..... 473/340
D399,290 S 10/1998 Sizemore, Jr.
5,830,078 A 11/1998 McMahan
5,839,974 A 11/1998 McAllister
D410,056 S 5/1999 McMahan
D415,228 S 10/1999 Besnard
5,993,324 A 11/1999 Gammil
D430,631 S 9/2000 Garcia
6,375,583 B1 4/2002 Solheim
D461,514 S 8/2002 Tang et al.
D461,515 S 8/2002 Tang et al.
D461,860 S 8/2002 Tang
D461,861 S 8/2002 Tang et al.
D463,002 S 9/2002 Tang et al.
6,688,990 B2 * 2/2004 Sanchez ..... 473/340
D488,200 S * 4/2004 Olsavsky et al. ..... D21/743
2002/0025859 A1 * 2/2002 Finn ..... 473/340
2002/0034986 A1 3/2002 Helmstetter et al.
2002/0107086 A1 8/2002 Cameron
2002/0123393 A1 9/2002 Tang et al.
2003/0036438 A1 * 2/2003 Tang et al. ..... 473/242

* cited by examiner

GOLF CLUB HEAD

BACKGROUND OF THE INVENTION

The present invention relates generally to a golf club head and, more particularly, to a putter head.

Putting is an important aspect of the game of golf. During a typical round of golf, a putter is the club most often used. To putt effectively, a golfer must predict a path of travel from the golf ball's stationary position to the cup. Then, using the putter, the golfer must strike the ball with the appropriate force and alignment to cause the ball to roll along the predicted path.

Misalignment of the putter with respect to the ball during impact, i.e., off-center hits, is a chief source of error in putting. Upon impact with the ball in an off-center hit, the putter undergoes angular acceleration, both longitudinally (i.e., about a heel-to-toe axis) and laterally (i.e., about a front-to-rear axis). This causes the ball to deviate from the predicted path. A club head's moment of inertia is a measure of the club's ability to resist angular acceleration about a particular axis. Although attempts have been made to counteract angular acceleration from off-center hits, they have been deficient in some respects. For example, prior approaches have not properly accounted for angular acceleration, about both longitudinal and lateral axes.

It should, therefore, be appreciated that there exists a need for a putter having enhanced moment of inertia characteristics for improved off-center hit accuracy. The present invention fulfills this need and others.

SUMMARY OF THE INVENTION

A putter head is provided having enhanced moment of inertia and alignment characteristics. The putter head includes a front body and a weight body. The weight body has a central weight section extending rearwardly from the front body a prescribed distance to a rear weight section. The putter head is configured such that the rear weight section has a width less than the width of the front body and greater than a width of the central weight section. Thus, the putter head has relatively high longitudinal and lateral moments of inertia to offer greater forgiveness and increased accuracy during putts, even for off-center hits.

In a preferred embodiment, the central weight section includes at least one and more preferably two elongated, high-density elements, such as, tungsten rods, that are visible on a top surface of the sole between the front body and the rear weight section, and the rear weight section includes a rear weight element having a high density. The visibility of the elongated elements, with optional parallel marking(s) on the top surface, also act as alignment aids to the golfer.

In a detailed aspect of a preferred embodiment, the front body includes a face plate that defines at least a portion of the front surface.

In another detailed aspect of a preferred embodiment, the rear weight section has a height greater than the height of the sole and less than the height of the front body.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
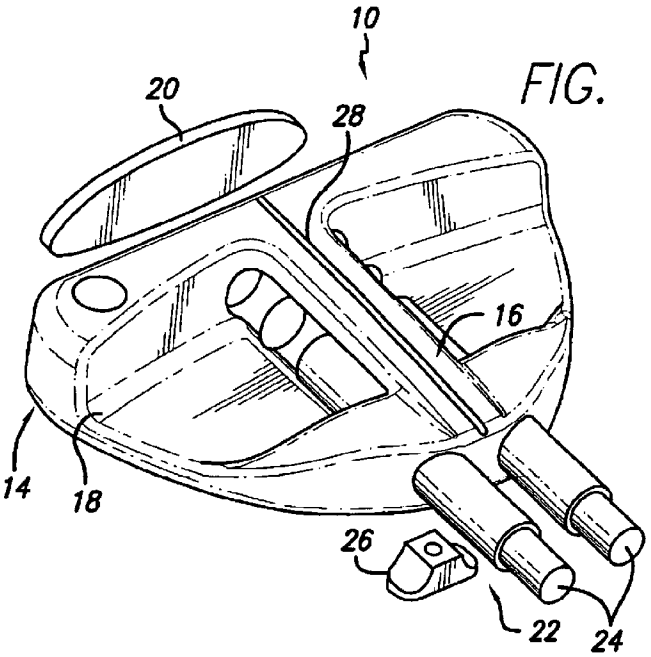
FIG. 1 is a partially exploded view of a putter head in accordance with one embodiment of the invention, depicting a body, a face plate and a weight assembly.

With reference now to the illustrative drawings, and particularly FIG. 1, there is shown a putter head 10 that includes a front body 14 and a weight body 16 extending rearwardly therefrom. The front body 14 includes a face plate 20, and the weight body 16 includes a weight assembly 22 disposed therein. The weight assembly 22 includes two elongated weight members 24 and a rear weight element 26, and is generally aligned along a centerline of the putter head 10. The centerline of the putter head may be indicated by a reference indicia 28. The elongated weight members 24 may extend rearwardly from a rear surface of the front body throughout the length of the weight body. The putter head 10 resists twisting on off-center hits, both longitudinally (i.e., about a heel-to-toe axis) and laterally (i.e., about a front-to-rear axis), resulting in predictable and accurate putts. Also, the elongated weight members 24 are visible from above the putter head, to serve as alignment aids to the golfer.

Figure 2:
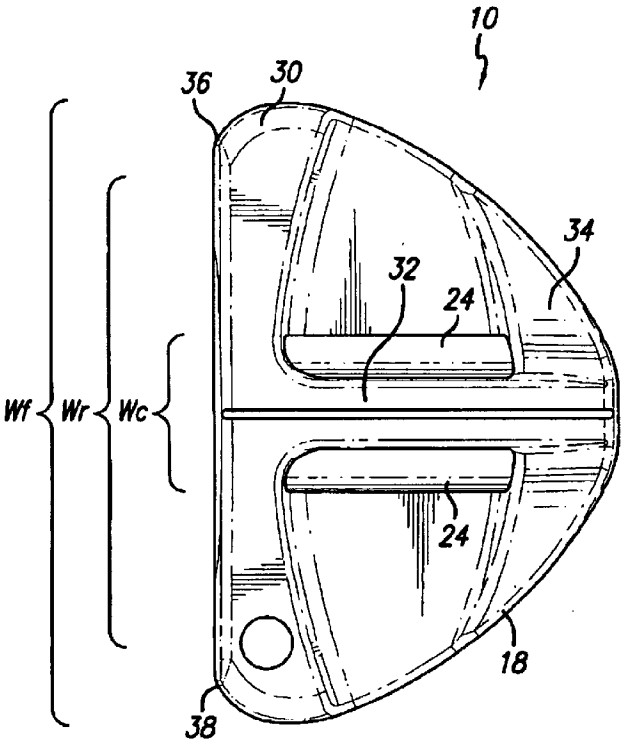
FIG. 2 is a top plan view of the putter head of FIG. 1.

With reference now to FIG. 2, the front body 14 is elongated and oriented generally perpendicular to the centerline of the putter head 10. In this embodiment, the front body 14 includes the face plate 20 and a forward section 30, and the weight body 16 includes a central weight section 32 and rear weight section 34. The central weight section 32 projects rearwardly from a mid-portion of the front body 14 and is oriented generally perpendicular to a front surface of the front body 14. The rear weight section 34 is spaced from the front body 14 by at least 2.5 cm, with the central weight section 32 extending between the front body 14 and the rear weight section 34. The front body 14 has a width ($W_f$) measured from a toe end 36 to a heel end 38 of the putter head 10, and the rear weight section 34 has a width ($W_r$) less than the width of the front body 14 and greater than a width ($W_c$) of the central weight section 32. Beneficially, the configuration of the weight body 16 aids in providing the putter head 10 with a high moments of inertia to resist twisting at impact. In one embodiment, the elongated weight members 24 may extend through the rear weight section 34 such that portions of the elongated weight members 24 are visible at a rear end of the putter head 10.

Figure 3:
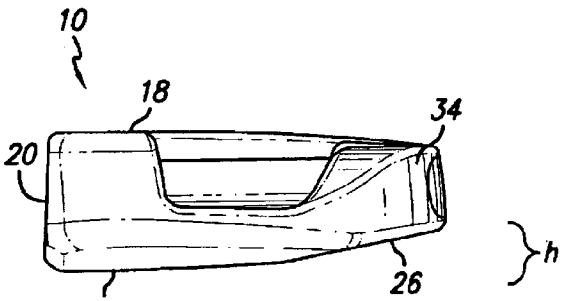
FIG. 3 is a side elevational view of the putter head of FIG. 1.
Figure 4:
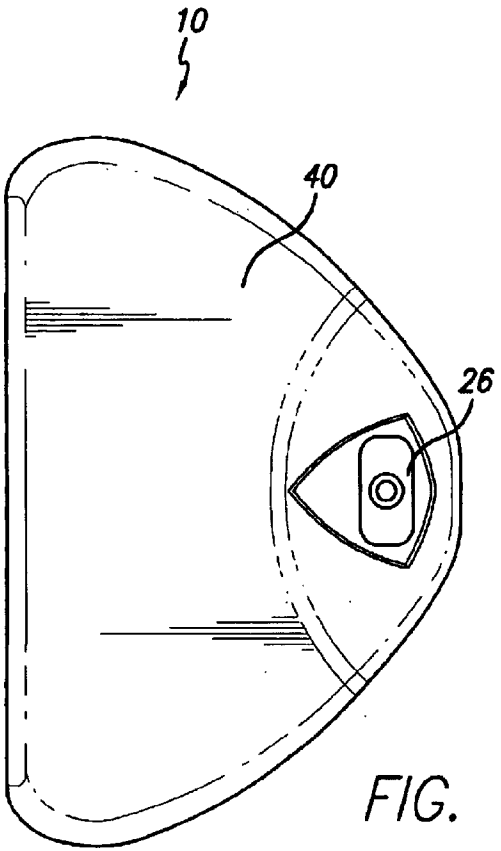
FIG. 4 is a bottom plan view of the putter head of FIG. 1.

With reference now to FIGS. 3 and 4, the putter head 10 includes a body piece 18 that defines a sole 40 and a cavity for receiving the rear weight element 26 located in the rear weight section 34. The sole 40 extends rearwardly from the front surface of the front body 14. The rear weight section 34 is generally aligned along the centerline of the putter head 10. The sole 40 pitches upwardly along the rear weight section 34 such that the rear weight element 26 is positioned a height (h) from the lowest portion of the sole 40 along a centerline of the putter head 10. The front body has a height measured from a bottom to a top of the front surface. The rear weight section has a height greater than the height of the sole and less than the height of the front body. In this embodiment, the sole 40 extends between the front body 14 and the rear weight section 34. This sole configuration provides a consistent backdrop for the alignment aids (e.g., reference indicia 28, elongated weight members 24) atop the putter head 10, thereby facilitating proper alignment with the golf ball.

Figure 5:
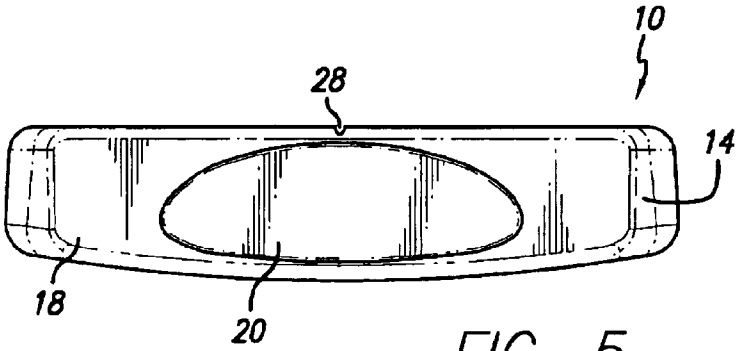
FIG. 5 is a front elevational view of the putter head of FIG. 1.
Figure 6:
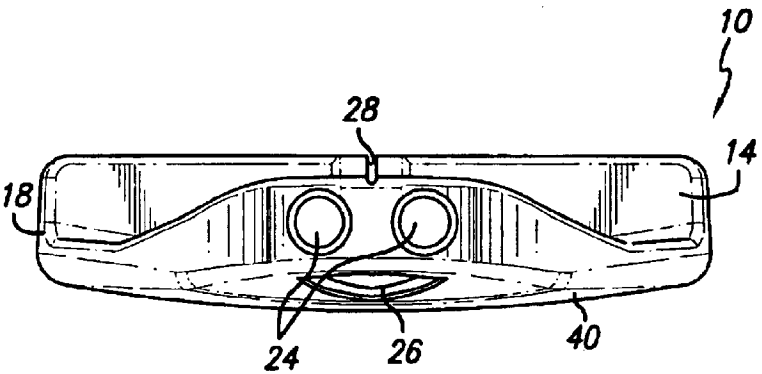
FIG. 6 is a rear elevational view of the putter head of FIG. 1.

As shown in FIGS. 5 and 6, the face plate 20 is disposed within a recess defined in the forward section 30 and defines at least a portion of a front surface of the front body 14. The face plate 20 is preferably formed from an aluminum alloy, but may also be a non-metal such as Pebax® or other material. The forward section 30 preferably is formed of 303 or 304 stainless steel alloys or 1020 carbon steel. Alternatively, the putter head 10 may be formed of other steel alloys, aluminum alloys or titanium alloys, as well as any combination of metals and non-metals, as desired. Elongated weight members 24 maybe be formed from a high density material, such as tungsten. Preferably, the forward section 30 has a density less than 10 g/cc, and the weight assembly 22 has a density greater than 11 g/cc.

Figure 7:
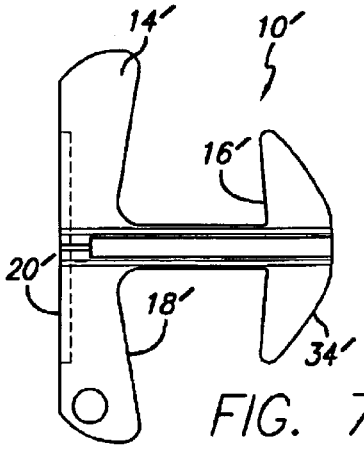
FIG. 7 is a top plan view of a second preferred embodiment of a putter head in accordance with the invention.
Figure 8:
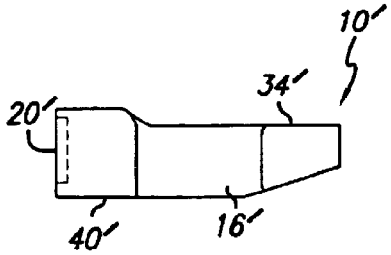
FIG. 8 is a side elevational view of the putter head of FIG. 7.
Figure 9:
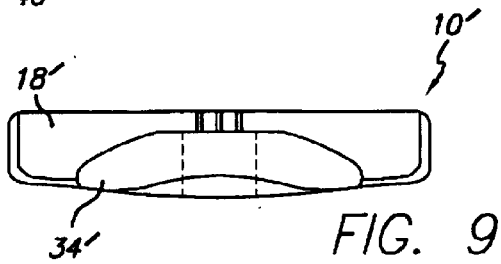
FIG. 9 is a rear elevational view of the putter head of FIG. 7.

FIGS. 7–9 depict a second preferred embodiment of a putter head 10' in accordance with the invention. This putter head 10' has a front body 14' and a weight body 16'. Front body 14' has a two-piece configuration, i.e., a body piece 18' and a face plate 20'. Weight body 16' includes a rear weight section 34' and a central weight section. Notably, the sole 40' does not extend between the front body 14' and the rear weight section 34' of the weight body 16', and the weight body 16' has a generally consistent density throughout.

Figure 10:
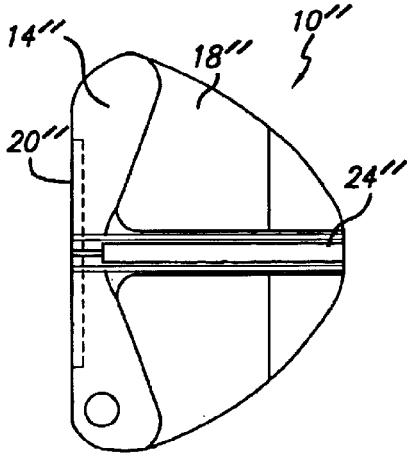
FIG. 10 is a top plan view of a third preferred embodiment of a putter head in accordance with the invention.
Figure 11:
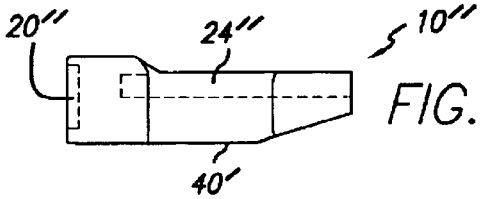
FIG. 11 is a side elevational view of the putter head of FIG. 10.
Figure 12:
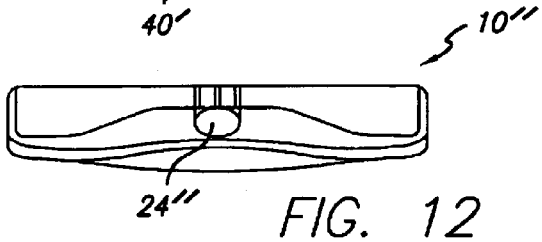
FIG. 12 is a rear elevational view of the putter head of FIG. 10.

FIGS. 10–12 depict a third preferred embodiment of a putter head 10" in accordance with the invention. This putter head 10" includes a body piece 18" that defines a sole 40" configured to extend between a front body 14" and a rear weight section 34" of a weight body 16". A face plate 20" is disposed within a recess defined in the front body 14". Putter head 10" also includes an elongated weight member 24" disposed along the centerline of the putter head 10" such that a portion of the elongated weight member 24" is visible from above the putter head 10". Elongated weight member 24" maybe be formed from a high density material, such as tungsten.

Figure 13:
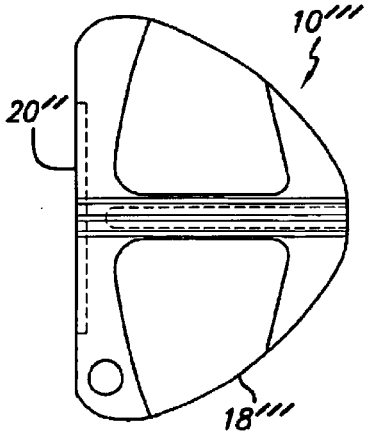
FIG. 13 is a top plan view of a fourth preferred embodiment of a putter head in accordance with the invention.
Figure 14:
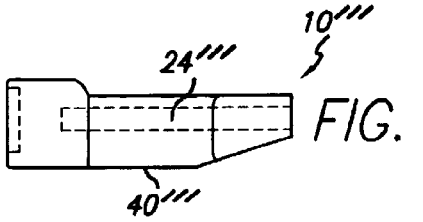
FIG. 14 is a side elevational view of the putter head of FIG. 13.
Figure 15:
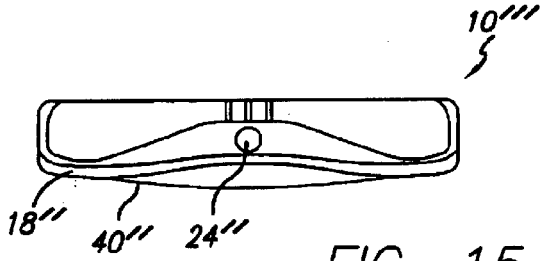
FIG. 15 is a rear elevational view of the putter head of FIG. 13.

FIGS. 13–15 depict a fourth embodiment of a putter head 10''' in accordance with the invention. This putter head 10''' includes a body piece 18''' that defines a sole 40''' configured to extend between a front body and a rear weight section of a weight body. A face plate 20''' is disposed within a recess defined in the front body. Putter head 10''' also includes an elongated weight member 24''' disposed along the centerline of the putter head 10''' and enclosed within the weight body such that the elongated weight member 24''' is not visible from above the putter head 10'''. Elongated weight member 24''' maybe be formed from a high density material, such as tungsten.

It should be appreciated from the foregoing that the present invention provides a putter head having enhanced inertia and alignment characteristics. The putter head includes a front body and a weight body. The weight body has a central weight extending rearwardly from the front body a prescribed distance to a rear weight. The putter head is configured such that the rear weight has a width less than the width of the front body and greater than a width of the central weight. Thus, the putter head has relatively high longitudinal and lateral moments of inertia to offer greater forgiveness and increased accuracy during putts, even for off-center hits.

Although the invention has been disclosed in detail with reference only to the preferred embodiments, those skilled in the art will appreciate that additional putter heads can be made without departing from the scope of the invention. Accordingly, the invention is defined only by the claims set forth below.

We claim:

1. A putter-type golf club head comprising:

a front body defining a front surface and an opposing rear surface, the front body having a width measured from a toe end to a heel end;

a central weight section projecting rearwardly from a mid-portion of the front body and oriented generally perpendicular to the front surface of the front body;

a rear weight section spaced from the front body such that the central weight section extends therebetween, the rear weight section having a width less than the width of the front body and greater than a width of the central weight section; and a sole extending from the front body to the rear weight section, wherein the sole is directly coupled to the central weight section;

wherein the rear weight section is spaced apart from the front body by at least 2.5 cm.

2. The putter-type golf club head of claim 1, wherein the front body is comprised of a material having a density of less than 10 g/cm$^3$.

3. The putter-type golf club head of claim 1, wherein a maximum height of the rear weight section is less than maximum height of the front body.

4. A putter-type golf club head comprising:

a front body having a front surface adapted to strike a golf ball, a rear surface opposing the front surface, a toe end, and a heel end;

a rear weight section coupled to the front body;

a sole extending from the front body to the rear weight section;

a first elongated rod extending axially from the rear surface of the front body to the rear weight section, wherein a junction of the first elongated rod and the rear surface is disposed between a centerline of the golf club head and the toe end; and a second elongated rod extending axially from the rear surface of the front body to the rear weight section, wherein a junction of the second elongated rod and the rear surface is disposed between the centerline of the golf club head and the heel end.

5. The putter-type golf club head of claim 1, further comprising a central weight section extending from a mid-portion of the rear surface to the rear weight section, wherein the central weight section is generally perpendicular to the front surface.

6. The putter-type golf club head of claim 1, wherein the front body is comprised of an aluminum alloy, a steel alloy, a titanium alloy, or combinations thereof.

7. The putter-type golf club head of claim 1, wherein the front body is comprised of a material having a density of less than 10 g/cm$^3$.

8. The putter-type golf club head of claim 1, wherein the first and second elongated rods are comprised of tungsten.

9. The putter-type golf club head of claim 1, wherein the first and second elongated rods are comprised of a material having a density greater than about 11 g/cm$^3$.

10. The putter-type golf club head of claim 1, wherein the front body has a front body width measured from the toe end to the heel end, and wherein a maximum width of the rear weight section is less than the front body width.

11. The putter-type golf club head of claim 1, wherein a maximum width of the rear weight section is greater than a maximum width of the central weight section.

12. The putter-type golf club head of claim 1, wherein the rear weight section is disposed at least 2.5 cm away from the front body.

13. The putter-type golf club head of claim 4, wherein a maximum height of the rear weight is less than a maximum height of the front body weight.

14. The putter-type golf club head of claim 4, further comprising a centerline indicia extending across a top portion of the golf club head.

15. The putter-type golf club head of claim 4, wherein portions of the first and second elongated rods disposed between the front body and the rear weight section are visible from above the golf club head.

16. The putter-type golf club head of claim 4, wherein the axis of the first elongated rod and the axis of the second elongated rod are each generally perpendicular to the front surface of the front body.

17. The putter-type golf club head of claim 4, wherein the sole is directly coupled to the central weight section.

18. The putter-type golf club head of claim 4, wherein a maximum height of the rear weight is greater than a maximum height of the sole.

19. A putter-type golf club head comprising:

a front body having a front surface adapted to strike a golf ball, a rear surface opposing the front surface, a toe end, a heel end, and a front body width measured from the toe end to the heel end;

a central weight section directly coupled to the rear surface of the front body and extending rearwardly therefrom along a centerline of the golf club head, wherein the central weight section is generally perpendicular to the front surface;

a rear weight section directly coupled to the central weight section and extending rearwardly therefrom;

a sole extending between the front body and the rear weight section and directly coupled to the central weight section;

a first elongated rod extending axially from the rear surface of the front body to the rear weight section, wherein the axis of the first elongated rod is generally perpendicular to the front surface of the front body, and wherein a junction of the first elongated rod and the rear surface is disposed between the centerline of the golf club head and the toe end; and a second elongated rod extending axially from the rear surface of the front body to the rear weight section, wherein the axis of the second elongated rod is generally perpendicular to the front surface of the front body, and wherein a junction of the second elongated rod and the rear surface is disposed between the centerline of the golf club head and the heel end;

wherein a maximum width of the rear weight section is less than the front body width, the maximum width of the rear weight section is greater than a maximum width of the central weight section, the rear weight section is disposed at least 2.5 cm away from the front body, and portions of the first and second elongated rods are visible from above the putter head.

20. The putter-type golf club head of claim 19, wherein the front body is comprised of an aluminum alloy, a steel alloy, a titanium alloy, or combinations thereof.

21. The putter-type golf club head of claim 19, wherein the first and second elongated rods are comprised of tungsten.

22. The putter-type golf club head of claim 19, further comprising a centerline indicia across a top portion of the golf club head.

23. A putter-type golf club head comprising:

a first body having a front surface configured to strike a golf ball, a rear surface opposing the front surface, a toe end, and a heel end;

a second body coupled to the first body and extending rearwardly therefrom, the second body having a top surface and a bottom surface, the bottom surface forming a portion of a sole, the top surface having a centerline indicia extending at least a portion of the length of the second body along a centerline of the golf club head, wherein the centerline is generally perpendicular to a ball striking portion of the front surface;

a first elongated rod extending rearwardly from the rear surface of the first body such that at least a portion of the length of the first elongated rod is visible from above the golf club head, wherein a junction of the first elongated rod and the rear surface is disposed between the centerline indicia and the toe end; and a second elongated rod extending rearwardly from the rear surface of the first body such that at least a portion of the length of the second elongated rod is visible from above the golf club head, wherein a junction of the second elongated rod and the rear surface is disposed between the centerline indicia and the heel end;

wherein the first and second elongated rods are symmetrically disposed about the centerline indicia such that the first and second elongated rods and the centerline indicia together serve as alignment aids.

24. The putter-type golf club head of claim 23, wherein the front body is comprised of an aluminum alloy, a steel alloy, a titanium alloy, or combinations thereof.

25. The putter-type golf club head of claim 23, wherein the first and second elongated rods are comprised of a material having a density greater than about 11 $g/cm^3$.

26. The putter-type golf club head of claim 23, wherein the second body extends rearwardly beyond the first and second elongated rods.

27. The putter-type golf club head of claim 23, wherein the first and second elongated rods each have of a length of at least 2.5 cm.

* * * * *